United States Patent [19]

Wood

[11] Patent Number: 4,727,943

[45] Date of Patent: Mar. 1, 1988

[54] ROTARY DRILL BIT

[76] Inventor: Roy W. Wood, 119 Persimmon St., Birmingham, Ala. 35214

[21] Appl. No.: 3,439

[22] Filed: Jan. 15, 1987

[51] Int. Cl.[4] ..... E21B 10/18; E21B 10/20; E21B 10/24; E21B 10/44

[52] U.S. Cl. ..... 175/229; 175/340; 175/356; 175/374; 175/394

[58] Field of Search ..... 175/331, 337, 339, 340, 175/366, 367, 371, 357, 355, 227, 356, 228, 229, 375, 374, 394, 358

[56] References Cited

U.S. PATENT DOCUMENTS

| | | | |
|---|---|---|---|
| 1,289,179 | 12/1918 | Hughes | 175/357 X |
| 2,132,498 | 10/1938 | Smith et al. | 175/355 X |
| 2,676,790 | 4/1954 | Turner | 175/227 X |
| 4,068,731 | 1/1978 | Garner et al. | 175/339 |
| 4,222,447 | 9/1980 | Cholet | 175/340 |
| 4,249,621 | 2/1981 | Espana | 175/227 |
| 4,343,371 | 8/1982 | Baker, III et al. | 175/374 X |
| 4,372,399 | 2/1983 | Cork | 175/339 X |
| 4,496,013 | 1/1985 | Serpa | 175/374 |
| 4,549,616 | 10/1985 | Rumpp et al. | 175/323 X |
| 4,591,008 | 5/1986 | Oliver | 175/227 |

*Primary Examiner*—Stephen J. Novosad
*Attorney, Agent, or Firm*—John K. Donaghy

[57] ABSTRACT

A drill bit for drilling into earth formations comprising a plurality of sections having connection means to connect said sections to form a unitary drill bit; means in said plurality of sections for storing and delivering lubricants to the cutting cones; and wear bar segments on said plurality of sections to form continuous wear bars about the periphery of said unitary drill bit thus reducing the wear on said unitary drill bit.

14 Claims, 9 Drawing Figures

ROTARY DRILL BIT

BACKGROUND OF THE INVENTION

1. Field of the Invention

This invention pertains to a drill bit for drilling earth bores into earth formations.

2. Background of the Prior Art

The prior art discloses drill bits attached to a rotary drill system which includes hollow drill strings attached to a drilling device. The hollow drill strings permit passage of either drilling mud or gaseous drilling fluid such as air entrained with water to the drill bit to function as a cooling medium for the drill cones and bearings and as a medium for conveying the cuttings to surface. Such drill bits contain openings, nozzles and the like for discharging the drilling fluid from the drill bit to and around the surface being drilled to convey dust and cuttings away from the cutting area and the drill bit cones to the surface.

Such drill bits are made of generally but not restricted to three forged sections, each containing a cutting cone with bearings.

Representative of the prior art devices are disclosed in U.S. Pat. Nos. 3,924,695 and 4,022,285.

SUMMARY OF THE INVENTION

There is a need for a drill bit which can be disassembled into several components and can be rebuilt and reassembled whereby the reassembled unit conforms to the original specifications at all wear points.

It is therefore an object of this invention to provide a drill bit having separable sections each of which may be remanufactured to conform to original specifications.

It is yet another object of this invention to provide a drill bit having separable helical, sprial sections which spiral in the opposite direction of the torque produced by the rotation and loading of the drill during drilling thus eliminating the stress experienced on presently used bits.

And still another object of this invention is to provide a drill bit having separable helical, spiral sections, each of which has wear bars which, when the sections are assembled, form continuous stabilizing wear bars spiralling about the periphery of the drill bit. This construction, eliminates the need for a bit stabilizing adaptor sub which is well known in the industry.

Still another object of this invention is to provide a drill bit having separable helical, spiral sections wherein each section has means for dividing the liquid or gaseous fluid used for impinging on cuttings and dust from the cutting cone area and expelling them out of the drill hole.

And another object of this invention is to provide a drill bit with separable helical, spiral sections, each section having its own thread which is identical to the threads on the other two pieces. Each section has a tapered thread and an alignment groove so that when the sections are assembled, guide pins in the female coupling must each find its alignment groove and drop to a shoulder simultaneous before the threads can be engaged. This construction prevents any cross threading as in the state of the art bits.

And yet another object of this invention is to provide each helical, spiral section with an oval recess in the inside radius descending along its spiral to nest a grease tube which extends from a storage reservoir to a machined recess for conveying grease to the bearings of the cutting cones.

These and other objects of the invention will become apparent to those skilled in the art to which the invention pertains for a reading of the following specification when taken in light of the annexed drawings.

DETAILED DESCRIPTION OF THE PREFERRED EMBODIMENT OF THE INVENTION

Figure 1:
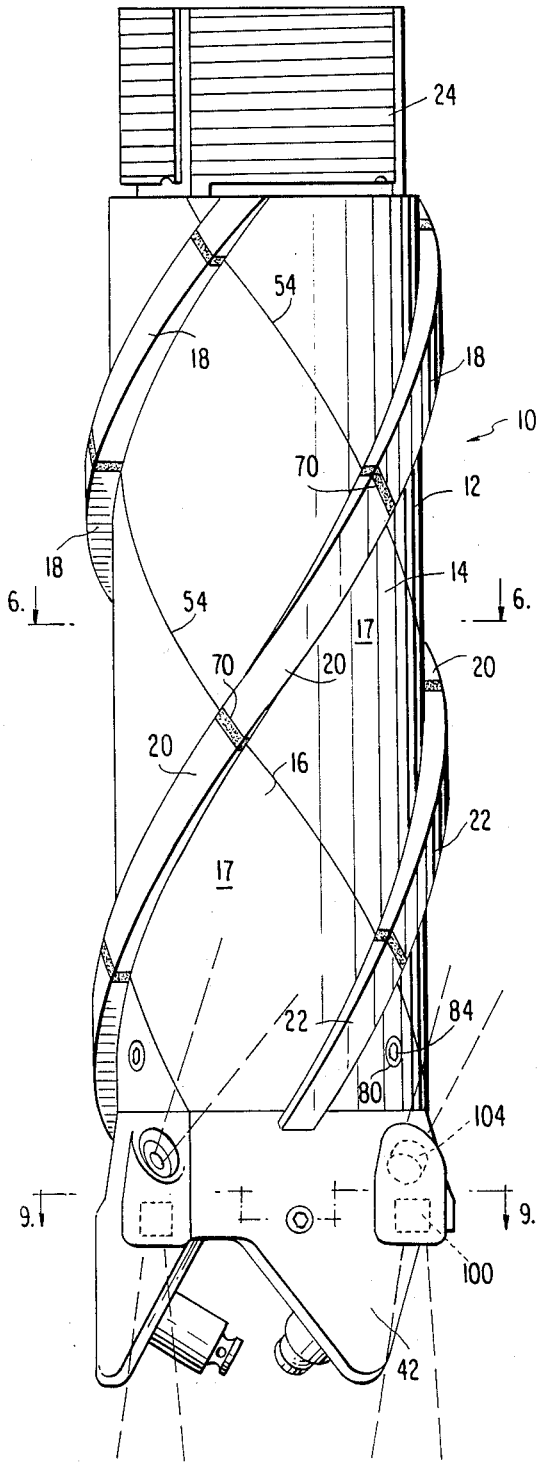
FIG. 1 is a perspective view of the drill bit of this invention showing three spiral sections and corresponding spiral wear bars.
Figure 2:
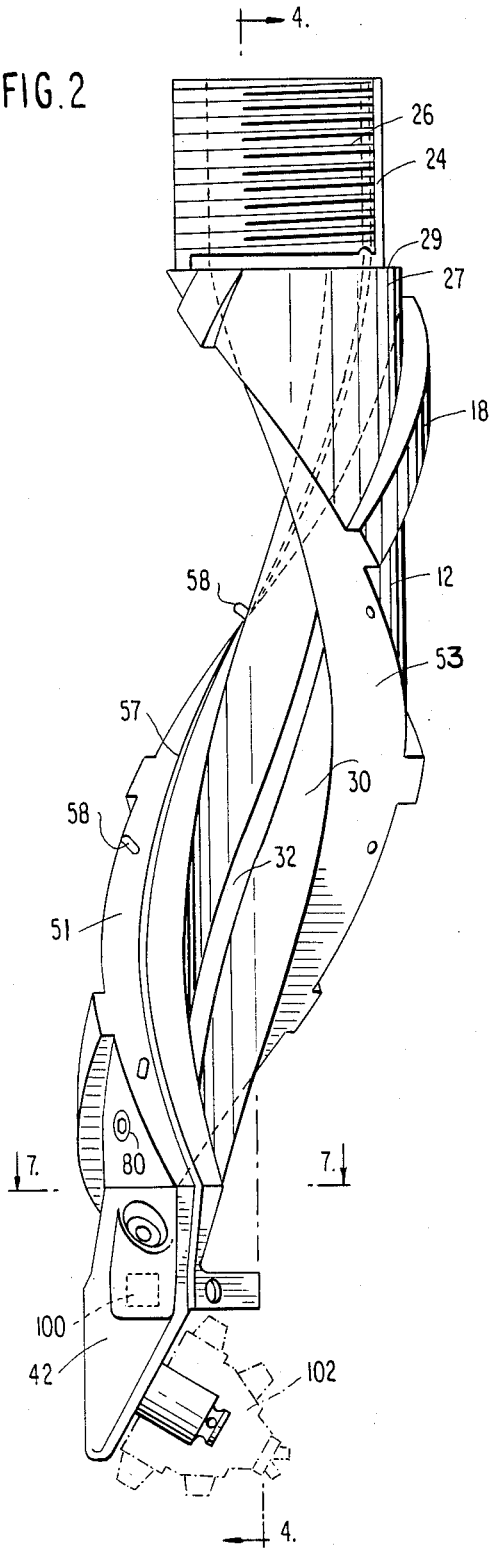
FIG. 2 is a perspective view of one of the spiral sections.

Turning now in more detail to the drawings, FIG. 1 shows a drill bit assembly 10 having separable helical, spiral sections 12, 14 and 16. Each segment 12, 14 and 16 is identical to each other and each have parallel raised wear bar segments 18, 20 and 22 integral with the body 17 of each section. FIG. 2. shows one of the sections 12 with raised parallel wear bar segments having an upper portion 24 with tapered threads 26 which cooperate with tapered threads on portions 24 of the other sections 14 and 16 to provide a means for threadingly attaching the assembled bit 10 to the female section of the end of a drill string (not shown). The portion 24 is smaller in diameter than upper portion 27 whereby a ledge 29 is provided. It will be understood that each section is identical thus having identical ledges 29. Each section 12, 14 and 16 has smooth inside spiral walls 30, FIG. 2 and FIG. 4 having a continuous spiralling groove 32 along the length of the section from a point 34 directly below an upper grease tube receptacle 36 having a vent bore 38 therethrough to a lower tube grease receptacle 40 in the lower base or shirt 42 of each of the sections. A grease tube 44 is positioned in the groove 32 and has its upper end 46 with vent cap 48 positioned snugly in the receptacle 36. A vent bore 50 in the cap 48 aligns with the vent bore 38 in the receptacle 36 thus providing a communication to the interior of the drill string when the assembled bit 10 is attached thereto. The lower end 52 of the tube 44 is seated in receptacle 40 with a sealing O-ring 55 to seal the end of the tube in the receptacle.

Figure 6:
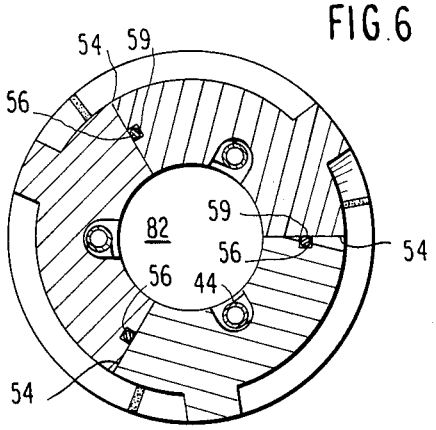
FIG. 6 is a plan view in section taken along the line 6—6 of FIG. 1.
Figure 7:
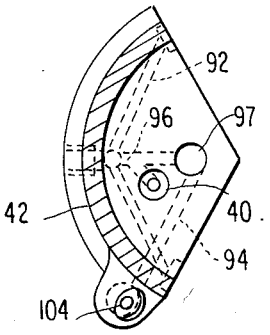
FIG. 7 is a plan view in section taken along the line 7—7 of FIG. 2.
Figure 9:
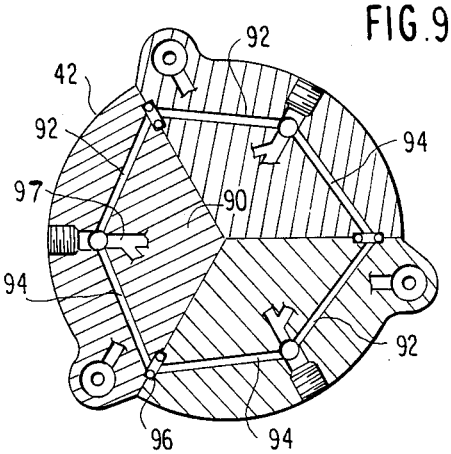
FIG. 9 is a plan view in section taken along the line 9—9 of FIG. 1.
Figure 4:
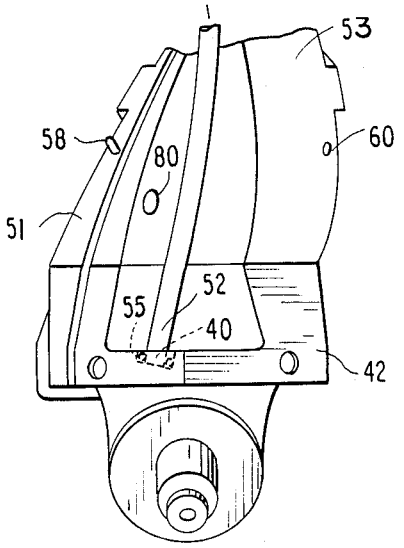
FIG. 4 is a view in section of the drill bit of FIG. 2 taken along the line 4—4.

Each section 12, 14 and 16 has flat edges 51 and 53 FIGS. 2 and 4, which cooperate with the identical flat edges of the other sections to form joints 54, FIGS. 1 and 6, having sealing means 56 and connector means 58. The sealing means 56 comprises a groove 57 extending the longitudinal extend of edges 50 of each of the sections in which there is compressible member 59. The connector means 58 comprises dowels which are received in bores 60 in edges 53 of each of the sections.

Figure 3:
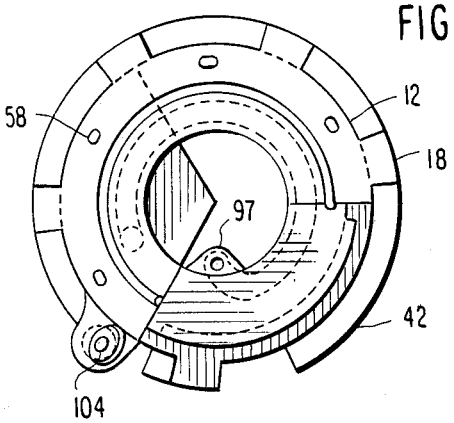
FIG. 3 is a plan view of the drill bit of FIG. 1.
Figure 3:
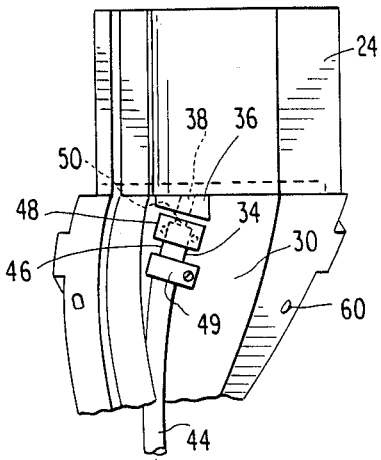

Thus, when the sections are brought together as shown in FIGS. 1, 3 and 6, the dowels 58 and bores 60 function as guides to align the edges 51 and 53 of each of the sections together and also as connectors to maintain the sections in perfect alignment. The sealing members 59 in each of the sections act to seal the joints to prevent pressure loss from the plenum chamber created when the sections are assembled as shown in FIG. 1. Assembled as shown, the wear bar segments 18, 20 and 22 are aligned to form a continuous helical, spiral bars about the periphery of the bit 10 counter to the spiral sections 12, 14 and 16. The joints 70 of the wear bar sections 18, 20 and 22 are welded with any suitable welding material. It will be apparent that the inside of the bit thus assembled is hollow to form a plenum chamber to receive lubricants and coolants from the associated drill string to which the assembled bit 10 is attached.

It will be appreciated that the arrangement of the wear bars as shown in FIG. 1 conforms to a 180° wrap which provides four weld points. The wear bars can be arranged to form a wrap of 120° or they may be arranged in vertical fashion which would require only two weld points. The welds 70 are external of the bit outer surface 17 which allows for removal of the welds for easy disassembly of the bit into sections 12, 14 and 16.

Each section 12, 14 and 16 near the base or shirt portion 42 has a lateral bore 80, FIGS. 1, 2 and 4, extending into the hollow interior or plenum chamber 82, FIG. 6. The bores 80 in each of the sections have removable plugs 84 which, when removed, permits attachment of a pressure gauge (not shown) to measure plenum chamber pressure and calculate the flow of liquid and gaseous fluids to expel cuttings from the hole bore.

The base or shirt portion 42, FIGS. 1, 7–9 of each section 12, 14 and 16 has laterally projecting walls 90 which cooperates with the other walls 90 of the other sections when assembled, to form a bottom closure for the plenum chamber 82. Each wall 90 has lateral bores 92, 94 which align with identical lateral bores in the laterally projecting walls 90 of the other sections. O-rings 96 provide sealing means for the bores at the junctures whereby the bores 92, 94 form a continuous passage as shown. The bores 92, 94 have an inwardly extending bore 97 which opens in the receptacle 40 below the end 52 and O-ring 54 of grease tube 44, FIG. 4. It will be understood that each section 12, 14 and 16 has a grease tube as described.

On the base or skirt portion 42 and communicating with the plenum chamber 82 through orifice 97 and bore 99 is a jet nozzle 100 which facilitates the introduction of air or water or any combination of these into the bore hole adjacent the cutting cones 102, FIG. 2. Also communicating with the plenum chamber 82 is a second jet nozzle 104 whose angle of direction corresponds to, and is between, the angle of direction of the wear bars 18, 20 and 22. This creates an upward flow of air or water or a combination of these to convey cuttings to the surface. The nozzles 100 and 104 may each be changed to provide smaller or larger nozzles so that optimum amounts of pressure of liquid or gaseous fluid may be directed as needed to achieve only the uphole velocity required in each annular area to keep the cuttings and dust in suspension and expel them from the drill hole.

Each helical, spiral section 12, 14 and 16 has state of the art cutting cone 102, FIG. 2. These cutting cones are supplied lubricants through orifices 106, FIG. 8.

Figure 5:
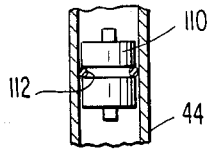
FIG. 5 is a view in section of a grease tube fitting.

Each helical, spiral section 12, 14 and 16 has its own storage means for lubricant through the medium of the grease tube 44. Each tube 44 has a floating piston 110, FIG. 5, having an O-ring 112 which engages the inner wall of the tube 44 and thus provides sealing means. The vent through cap 48 and orifice 38 prevents a vacuum from forming whereby the piston 110 easily moves downwardly in the grease tube forcing the grease into the well 40 and thence into the bores 92 and 94, 96 and 106 to the cutting cones 102. The downward movement of the floating piston 110 occurs as a result of the forces of gravity and centrifugal force as a result of the boring and drilling action. Air through orifice 97 and bore 96 causes the lubricant to be delivered under pressure to the bearings of the cutting cones.

Figure 8:
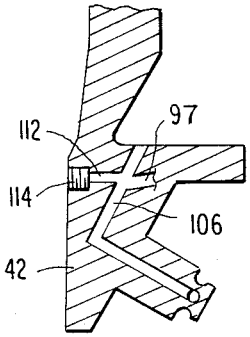
FIG. 8 is a vertical cross-section view through the bit skirt and the roller cone journal.

Each of the helical, spiral sections 12, 14 and 16 has a lateral bore 112, FIG. 8, which intersects bore 96 to the grease receptacle 40. The bore 112 has a grease fitting 114, which receives a female connector of a source of pressurized grease whereby the tube 44 may be replenished with lubricant. It will be appreciated that during the replenishment, the float 110 is forced upwardly until it comes to rest against the cap 48. Since the bore 112 intersects bore 106 and thus bores 92 and 94, only one grease fitting is required since it is common to all grease tubes 44 whereby they may be replenished simultaneously.

What I claim is:

1. A drill bit having cutting cones for drilling into earth formations comprising:
   - a plurality of helical sections having connecting means to connect said helical sections to form a unitary drill bit;
   - means in said helical sections for storing and delivering lubricants to said cutting cones; and
   - wear bar segments on said helical sections for forming a plurality of continuous parallel wear bars about the periphery of said unitary drill bit.

2. A drill bit having cutting cones for drilling into earth formations comprising:
   - a plurality of sections having connection means to connect said sections to form a unitary drill bit;
   - said plurality of sections comprising helical, spiral sections;
   - means in said plurality of sections for storing and delivering lubricants to the cutting cones; and
   - wear bar segments on said plurality of sections to form continuous wear bars about the periphery of said unitary drill bit thus reducing the wear on said unitary drill bit.

3. A drill bit having cutting cones according to claim 2, wherein:
   - said means in said sections for storing and delivering lubricants comprising grease tubes connected to bores leading to said cutting cones.

4. A drill bit having cutting cones according to claim 2, wherein:
   - said wear bar segments form parallel spirals on said unitary drill bit.

5. A drill bit having cutting cones according to claim 2, wherein:
   - said connecting means comprises welding means which are capable of being removed whereby said plurality of sections may be disassembled for repair.

6. A drill bit having cutting cones according to claim 2, wherein:

said plurality of sections having threaded sections which form a continuous threaded neck for connection to a drill string.

7. A drill bit having cutting cones according to claim 6, and:

said continuous threaded neck having means to align same with the receiving portion of a drill bit whereby cross threading is eliminated.

8. A drill bit having cutting cones according to claim 2, wherein:

said unitary drill bit having a plenum chamber having means communicating with the exterior of the drill bit whereby liquid or gaseous fluid means are supplied to expel cuttings cut by the cones to the exterior of the bore hole.

9. A drill bit having cutting cones according to claim 8, wherein:

said means communicating with said exterior comprising a plurality of orifices facilitating dividing the flow of liquid or gaseous fluid into optimum volumes to attain the correct velocity of liquid or gaseous fluid for removing the cuttings cut by the cutting cones to the surface of the drill hole.

10. A drill bit having cutting cones according to claim 9, wherein:

said plurality of orifices comprising a vertically downward nozzle adjacent said cutting cones and a vertical upward jet nozzle adjacent to said cutting cones having a projection parallel to and between said wear bars.

11. A drill bit having cutting cones according to claim 10, and:

said nozzles being changeable to provide variable size openings thereby adjusting the pressure of the liquid or gaseous material entering the drilling hole.

12. A drill bit having cutting cones according to claim 11, and:

one of said jet nozzles being a lower nozzle in the area adjacent the cutting cones and other being an upper jet nozzle in the area above the cutting cones.

13. A drill bit having cutting cones comprising:

a plurality of helical, spiral sections connected together to form a unitary drill bit;

said spiral sections separable to repair damage due to extensive use;

recesses in said sections for receiving grease tubes for delivering grease to said cutting cones; and a plurality of integrally cast wear bar segments on said plurality of helical, spiral sections for forming, when said sections are connected together, continuous reverse spiral wear bars on said unitary drill bit.

14. A drill bit having cutting cones according to claim 13, wherein:

said grease tubes having floating pistons therein whereby grease is delivered to said cutting cones as a result of gravitational and centrifugal forces resulting from said drilling action.

* * * * *